US005623297A

United States Patent [19]

Austin et al.

[11] Patent Number: 5,623,297

[45] Date of Patent: Apr. 22, 1997

[54] METHOD AND APPARATUS FOR CONTROLLING A THERMAL PRINTHEAD

[75] Inventors: Pixie A. Austin, Everett; Edward M. Millet, Seattle; Christopher A. Wiklof, Everett, all of Wash.

[73] Assignee: Intermec Corporation, Everett, Wash.

[21] Appl. No.: 88,846

[22] Filed: Jul. 7, 1993

[51] Int. Cl.[6] ..... B41J 2/36; B41J 2/365

[52] U.S. Cl. ..... 347/194; 347/195

[58] Field of Search ..... 347/194, 195, 347/14, 17, 182; 400/120.14, 120.15

[56] References Cited

U.S. PATENT DOCUMENTS

| | | | |
|---|---|---|---|
| 4,279,519 | 7/1981 | Shiurila | 400/124 |
| 4,434,356 | 2/1984 | Craig et al. | 219/216 |
| 4,531,134 | 7/1985 | Horlander | 346/76 PH |
| 4,573,058 | 2/1986 | Brooks | 346/76 PH |
| 4,590,484 | 5/1986 | Matsushita | 347/194 |
| 4,705,412 | 11/1987 | Matsumoto | 400/54 |
| 4,736,089 | 4/1988 | Hair et al. | 219/216 |
| 4,810,113 | 3/1989 | Itoh et al. | 400/124 |
| 4,819,001 | 4/1989 | Yokota | 346/76 PH |
| 4,836,697 | 6/1989 | Plotnick et al. | 400/120 |
| 4,980,702 | 12/1990 | Kneezel et al. | 346/140 R |
| 5,038,154 | 8/1991 | Yamamoto et al. | 347/194 |
| 5,051,756 | 9/1991 | Nomura et al. | 347/194 |
| 5,066,961 | 11/1991 | Yamashita | 347/194 |
| 5,083,137 | 1/1992 | Badyal et al. | 346/1.1 |

FOREIGN PATENT DOCUMENTS

| | | | |
|---|---|---|---|
| 0201681 | 11/1983 | Japan | 347/194 |
| 0229365 | 12/1984 | Japan | 347/194 |
| 0162565 | 7/1987 | Japan | 347/194 |

*Primary Examiner*—Huan H. Tran
*Attorney, Agent, or Firm*—Seed and Berry LLP

[57] ABSTRACT

A system for controlling the temperature of the printing elements of a thermal printhead. The printhead is provided with a plurality of spaced apart temperature sensor that measure the temperature at various locations on the printhead. A processor receiving outputs from the sensors determines the approximate temperature of each printing element based upon its proximity to at least one temperature sensor and the temperature sensor outputs. The processor then uses the approximate temperature of the printing elements to formulate either a strobe signal or a serial data stream that is applied to the respective printing element. Each printing element thus receives a quantity of energy that is a function of whether the printing element will contribute to the printing of an image during a scan line as well as the approximate temperature of the printing element.

45 Claims, 8 Drawing Sheets

METHOD AND APPARATUS FOR CONTROLLING A THERMAL PRINTHEAD

TECHNICAL FIELD

This invention relates to the field of thermal printers, and more particularly to a method and apparatus for controlling the printheads of thermal printers based on thermal feedback from the printheads used in such thermal printers.

BACKGROUND OF THE INVENTION

Thermal printers are commonly used to print alphanumeric characters and bar codes on a variety of printing media such as paper, label stock, tubing, etc. Thermal printers utilize a thermal printhead having formed therein a large number of thermal printing elements generally arranged in a row. The thermal printing elements are selectively heated to apply appropriate markings to the printing media, either directly or through a meltable transfer medium.

A thermal printhead can provide high-quality printing only if there is precise control of the temperature of the printing elements on the printhead. However, it can be difficult to precisely control the temperature of the printing elements because their temperature is not solely under the control of heating signals applied to the individual printing elements. Instead, the temperature of a printing element at any point in time is determined also by the energization history of the heating element as well as the current and past energization history of adjacent printing elements. In other words, for a given power of heating signal applied to a printing element, the temperature of the printing element will be higher if the printing element was energized during previous scans of the printhead and/or the adjacent printing elements are currently being energized or were energized during previous scan periods.

There have been several approaches that have been used to control the temperature of thermal printing elements. In the past, a single temperature sensor, such as a thermistor, has been used to provide an indication of the temperature of the entire printhead. However, thermistors sensing the temperature of the entire printhead at a single location are relatively slow to respond to rapid increases in the temperature of individual printing elements. The thermal feedback provided by this technique is thus too slow to precisely control the temperature of the printing elements. Also, feedback indicative of the overall temperature of the printhead is incapable of substantially assisting in the temperature control of individual printing elements. For example, if all of the printing elements on the right-hand side of a printhead are being energized while none of the thermal elements on the left-hand side of the printhead are being energized, the temperature of the right-hand side of the printhead will be significantly greater than the temperature of the left-hand side of the printhead. However, thermal feedback from a single temperature sensor is incapable of causing the control circuit to treat one side of the printhead differently from the other side of the printhead. In short, while a single temperature sensor may be helpful in providing long-term feedback of the overall temperature of the printhead, it is incapable of providing short-term feedback and feedback responding to the temperature variation between individual printing elements.

Another approach to controlling the temperature of thermal printing elements has been to record the energization history of the printing elements and use that history to control the energization of each printing element during each scan of the printhead. For example, whether a printing element was energized during each of the previous six scans of the printhead can be recorded, and the degree of energization of the printing element during the next scan of the printhead can be adjusted accordingly. Similarly, the present or past energization state of adjacent printing elements can be recorded and used to adjust the magnitude of energy applied to the printing element during the next scan of the printhead. If a given printing element was energized during previous printhead scans, or if the adjacent printing elements are energized during the present printhead scan or they were energized during previous printhead scans, then the energy applied to the printing element is reduced. Conversely, if the printing element was not energized during prior printhead scans and the adjacent printing elements were not energized during the current or previous printhead scans, then the energy applied to the printing element is increased. The use of a printing element history to control the energy applied to printing elements during a printhead scan markedly improves the control of printing element temperature. However, this energization history technique essentially provides only very short term feedback (i.e., on the order of several printhead scan times). The energization history technique can be combined with the above-described single temperature sensor technique to provide both very short-term feedback and very long-term feedback. However, even this approach does not provide optimum temperature control of printing elements because there is a relatively long period of time during which there is no thermal feedback. In other words, the energization history technique provides thermal feedback for the last several printhead scans while the single temperature sensor technique provides thermal feedback for relatively long periods of time covering a large number of printhead scans, but there is no thermal feedback covering the period between several printhead scans and a large number of printhead scans. As a result, it is very difficult to precisely control the temperature of printing elements using the above-described techniques.

SUMMARY OF THE INVENTION

It is an object of the invention to provide a system for more precisely controlling the temperature of the printing elements of a thermal printhead.

It is another object of the invention to provide a technique for precisely controlling printing element temperature which can be adapted to a variety of printhead control systems.

These and other objects of the invention are provided by placing a plurality of temperature sensors on a printhead of the type having a plurality of thermal printing elements arranged in a predetermined pattern. The temperature sensors each generate a respective temperature signal that is indicative of the temperature of the portion of the printhead containing the temperature sensor. The printhead is controlled by a printhead control system which includes a processor that determines the approximate temperatures of the printing elements based on the temperature signals from several temperature sensors. The processor then causes at least one signal to be applied to the printing elements based on whether the selected printing element is to print during the current printhead scan line and the approximate temperature of the printing element. The processor can determine the approximate temperature of the printing elements through any of a variety of techniques such as by interpolating between the temperatures of adjacent temperature sensors based on the proximity of a printing element to the temperature sensors, by assigning to a printing element the temperature of the closest temperature sensor, or by providing a temperature sensor for each printing element.

In one embodiment, the system includes a memory that contains a plurality of data bytes each of which corresponds to the quantity of energy that is to be added to a respective printing element based on the temperature of the printing element and whether the printing element contributes to the printing of an image during the current printhead scan line. The processor then addresses the memory to select a data byte for each of the printing elements based on two factors. First, whether a selected printing element is to contribute to the printing of the image; and, second, the approximate temperature of the printing element as a function of a temperature signal from at least one temperature sensor spatially associated with the selected printing element. Finally, a controller applies a power signal to the printing element as a function of the selected data byte. The memory preferably contains data bytes indicating the past and/or future printing history of both the selected printing element and the printing elements adjacent the selected printing element, and this data are used along with data indicative of the temperature of the selected printing element to determine the magnitude of a signal that is applied to the selected printing element. The memory may be divided into separate discrete memories including a temperature memory containing data indicative of the temperature of each of the printing elements, and a history memory containing data indicative of the printing elements that have and will contribute to the printing of the image during a plurality of scan line. The data in the temperature and history memories can then be used to address a table memory containing data indicative of a plurality of heating profiles, each of which corresponds to the energy that should be added to each printing element as a function of time based on the temperature of the printing element and whether the printing element has contributed and will contribute to the printing of the image during a plurality of scan lines. The table memory thus outputs a selected data byte which controls the heating of the selected printing element during the current scan line. Different sets of heating profile data may be stored in the table memory depending upon the nature of the print media or the print speed with which the image is printed.

In an alternative embodiment, the processor includes a strobe generator that produces a strobe signal as a function of the approximate temperature of the selected printing element. The strobe generator may be, for example, a waveform generator generating a pulse train having characteristics determined by the strobe program signal. The strobe generator may also be a waveform generator generating a plurality of different pulse trains at respective outputs, one of which is selected by a multiplexer as a function of the approximate temperature of one or more printing elements.

DETAILED DESCRIPTION OF THE INVENTION

Figure 1:
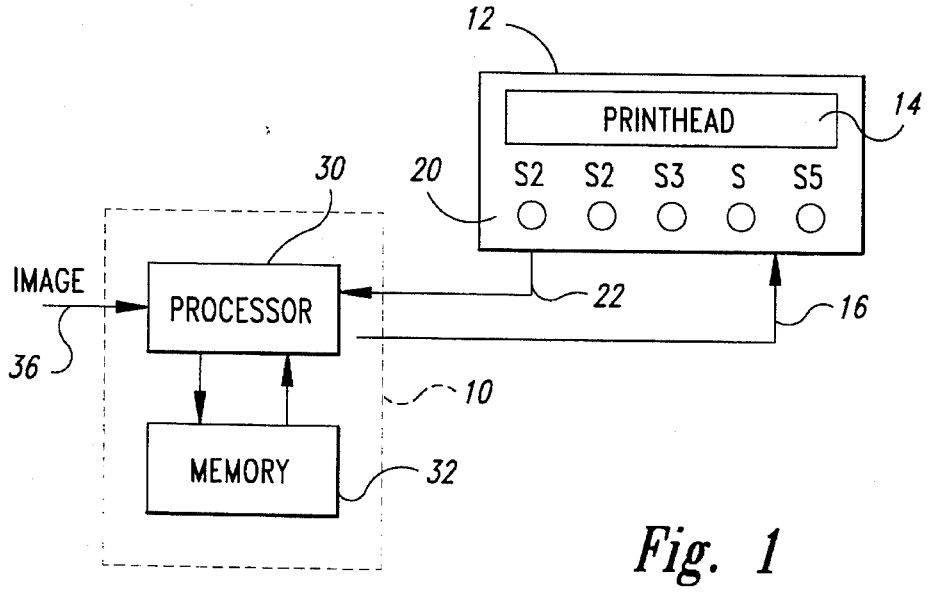
FIG. 1 is a block diagram of a presently preferred embodiment of the invention.

A presently preferred embodiment of the invention is illustrated in FIG. 1. The embodiment of FIG. 1 includes a control system 10 that is connected to a printhead 12 of the type that includes a field of thermal printing elements 14 that receive heating signals through respective input lines 16. As is well-known in the art, when a heating signal is applied to each of the printing elements 14, they become sufficiently hot to create markings on a printing medium, such as paper, either directly or through a thermal transfer medium. In the past, a single temperature sensor has been placed on such printheads 12. In the preferred embodiment of the invention, a plurality of temperature sensors 20 generate respective temperature signals on lines 22 indicative of the temperature of the printhead 12 at several spaced apart points. The use of a single temperature sensor can only provide a general indication of the temperature of all of the printing elements. However, the use of multiple temperature sensors allows the temperature of individual printing elements to be approximated, as explained in greater detail below. The temperature sensors 20 may be implemented using a variety of conventional technologies, such as thermocouples or thermistors.

A processor 30 of conventional design receives data on line 36 that are indicative of the image to be printed by the printhead 12. The image data is generated by conventional means and, in the interest of clarity and brevity, is not explained herein. Basically, the image data on line 36 identifies which of many (e.g., 256) printing elements are to be energized during each of a large number of scan lines which make up the image. In other words, the image can be thought of as a two-dimensional m×n matrix of m printing elements and scan lines. The processor 30 also receives the temperature signals from the temperature sensors 20 and determines the approximate temperature of each of the printing elements 14. The processor 30 may, but need not, store the resulting data in memory 32, which may be a conventional random access memory. The processor 30 may also store the image data in the memory 32. The processor then uses the approximate temperature of the printing elements 14 in combination with the image data to generate appropriate heating signals that are applied to the printing elements 14.

The control system 10 of FIG. 1 is able to more precisely control the temperature of the printing elements 14 because it is able to determine the approximate temperature of each of the printing elements 14. In the past, a single temperature sensor was capable of providing long-term thermal feedback indicative of the temperature of the printhead 12 after operating a substantial period. Short-term thermal feedback was also provided in the past by recording in memory 32 the energization history of each of the printing elements 14. However, this short-term history was on the order of several scan lines. The use of multiple temperature sensors 20 is advantageous because it not only allows temperature approximations to be made for each printing element 14, but it also provides intermediate term thermal feedback which greatly improves the ability to control the temperature of the printing elements 14. The presently preferred embodiment of FIG. 1 preferably stores in the memory 32 the energization history of each of the printing elements 14 to provide short term thermal feedback from the printhead 12 in addition to the intermediate term thermal feedback derived from the temperature sensors 20.

Figure 2:
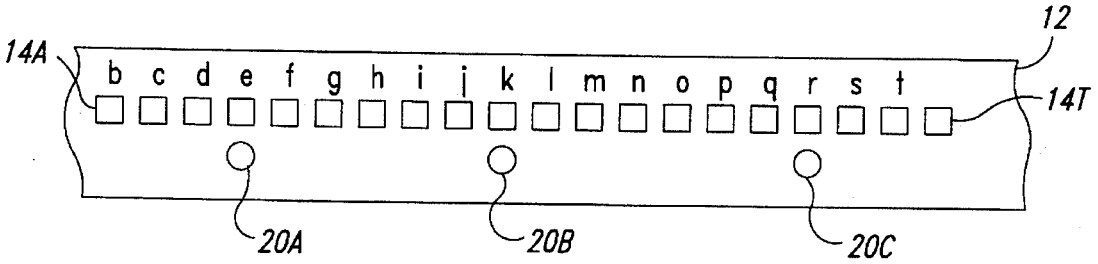
FIG. 2 is a schematic block diagram illustrating the spatial relationship between printing elements and temperature sensors of a thermal printhead.

The various means by which the processor 30 can determine the approximate temperature of the printing elements will now be explained with reference to FIG. 2. FIG. 2 illustrates a portion of the printhead 12 showing twenty printing elements 14*a*–14*t* and three temperature sensors 20*a*–20*c*. In the presently preferred embodiment of the invention, the printing head 12 includes 256 printing elements 14, and eight temperature sensors 20, so that there are 32 printing elements 14 for each temperature sensor 20.

Probably the simplest technique for approximating the temperature of the printing elements 14*a*–14*t* is to simply assign to the printing elements the temperature indicated by the closest temperature sensor. For example, in FIG. 2 printing elements 14*a*–14*g* would be assigned the temperature indicated by the temperature sensor 20*a*, printing elements 14*h*–14*n* would be assigned the temperature indicated by the temperature sensor 20*b*, and printing elements 14*o*–14*t* would be assigned the temperature indicated by the temperature sensor 20*c*. The printing elements 14*a*–14*t* may alternatively be assigned the average of the temperatures indicated by the temperature sensors which each of the printing elements 14*a*–14*t* is between. For example, if temperature sensor 20*a* indicated a temperature of 200° and temperature sensor 20*b* indicated a temperature of 240°, printing elements 14*d*–14*j* would be assigned a temperature of 220° (i.e., the average of 200° and 240°). A more sophisticated technique for approximating the temperature of the printing elements 14*a*–14*t* is interpolation based upon the temperature of the adjacent temperature sensors 20*a*–20*c* and the proximity of each printing element to those sensors. For example, assuming that temperature sensor 20*b* indicates a temperature of 240° and the temperature sensor 20*c* indicates a temperature of 275°, there would be a difference in temperature between the sensors 20*b*, 20*c* of 35°. Between temperature sensor 20*b* and temperature sensor 20*c* there are a total of seven printing elements 14*k*–14*r*. As a result, the temperature of each printing element 14 would increase by 5° from printing element 14*k* to printing element 14*r*. The temperatures of each of the printing elements 14*k*–14*r* would thus be given by the following table:

TABLE 1

| | |
|---|---|
| 14k | 240° |
| 14l | 245° |
| 14m | 250° |
| 14n | 255° |
| 14o | 260° |
| 14p | 265° |
| 14q | 270° |
| 14r | 275° |

The above-described interpolation technique requires more processing of the temperature signals from the temperature sensors 20*a*–20*c*. However, it provides closer approximations of the temperature of the printing elements 14 and is thus preferred for optimum results.

Figure 3:
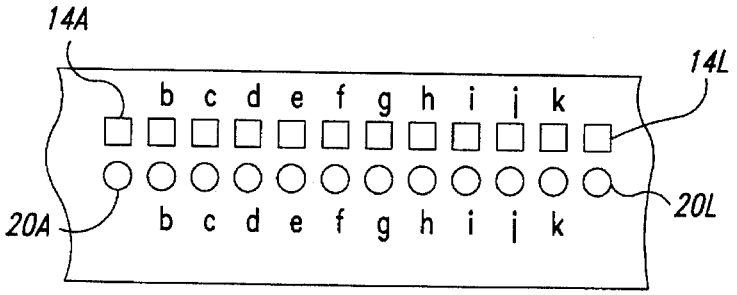
FIG. 3 is a schematic block diagram illustrating an alternative spatial relationship between the printing elements and temperature sensors of a thermal printhead.

An alternative printhead design for approximating the temperature of printing elements is illustrated in FIG. 3. The printhead 12' is shown in FIG. 3 with twelve printing elements 14*a*–14*l*, and fourteen temperature sensors 20*a*–20*l*. Each temperature sensor 20*a*–20*l* is positioned directly adjacent its correspondent printing element 14*a*–14*l*, respectively, so that there is a one-for-one correspondence between printing elements 14 and temperature sensors 20. The printhead 12' illustrated in FIG. 3 provides the most accurate temperature approximations of the printing elements 14*a*–14*l*, but it also may entail additional manufacturing expense in providing a large number of temperature sensors as well as additional processing for the relatively large number of temperature signals generated by the temperature sensors 20*a*–20*l*. However, using conventional techniques, the printing element 14 itself may provide an indication of its own temperature, thus simplifying the manufacturing process. Regardless of which technique is used, the inventive method and apparatus is able to provide more precise temperature control because it utilizes an approximate temperature for each printing element 14.

Figure 4:
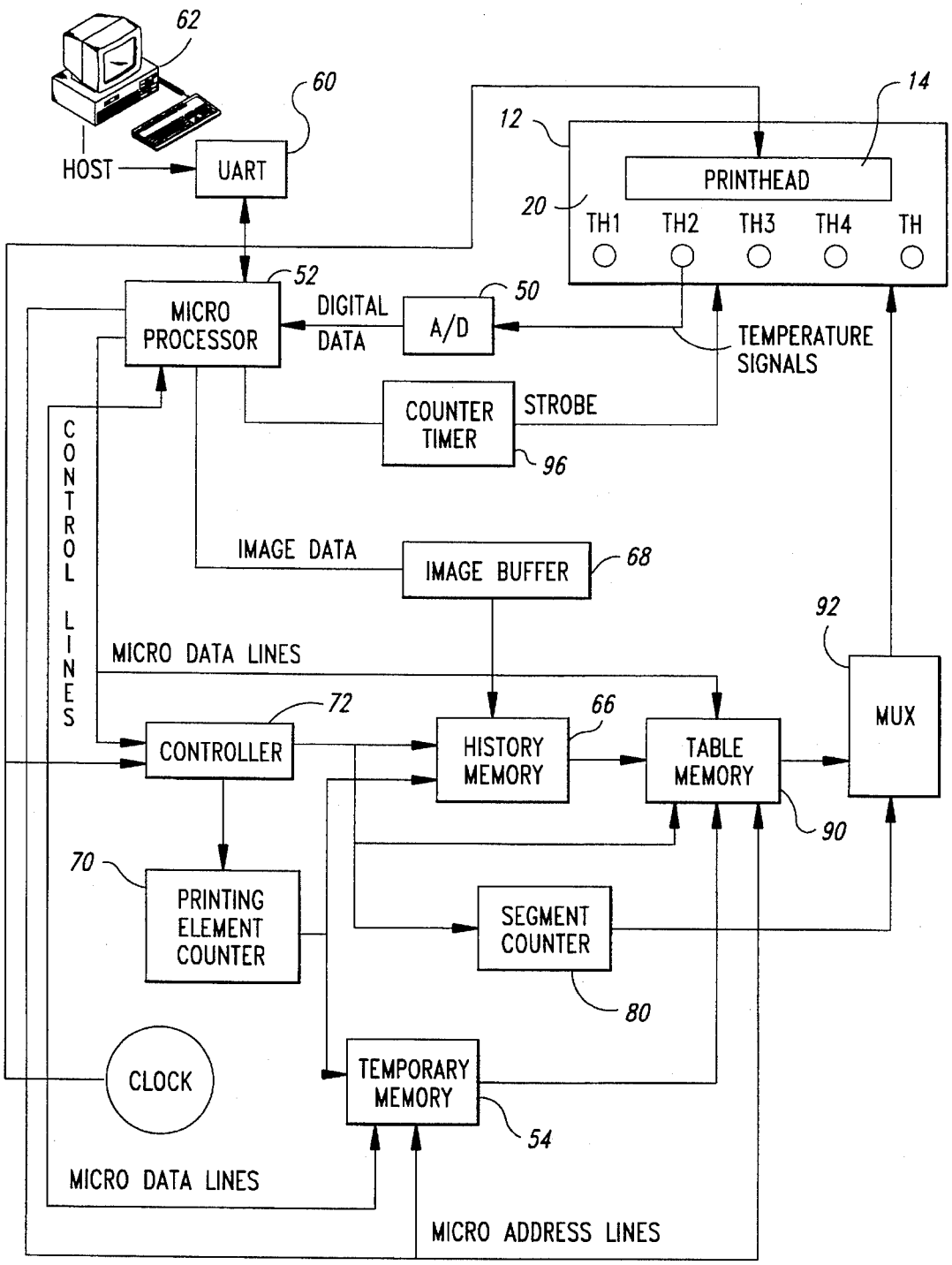
FIG. 4 is a block diagram showing one system for implementing the preferred embodiment of the invention illustrated in FIG. 1.

The preferred embodiment of the invention illustrated in FIG. 1 is shown in greater detail in one design illustrated in FIG. 4. In the embodiment of FIG. 4, the temperature signals output from the temperature sensors 20 are applied to a conventional analog-to-digital converter 50 which provides digital data indicative of the sensed temperature to a conventional microprocessor 52. The microprocessor 52 controls the operation of the remaining circuitry and it thus always contains information identifying the current scan line and printing element 14. The microprocessor 52 determines the approximate temperature of each of the printing elements 14 based upon the temperature signals from the temperature sensors 20 and the proximity of each of the printing elements 14 to each of the temperature sensors 20. The microprocessor 52 then causes these temperature approximations to be stored in temperature memory 54, which may be a conventional random access memory. Basically, there is a unique address for each printing element 14, and data indicative of the temperature of each printing element is stored in the address corresponding to that printing element 14.

The microprocessor 52 also receives serial data from a conventional UART 60 which, in turn, receives image data in a conventional manner from a microcomputer 62. The microprocessor 52 then determines which printing elements 14 should contribute to the printing of the image during each scan line. Data indicative of the future, present and past energization condition of each printing element 14 is stored in a history memory 66 which may be a conventional random access memory. While the temperature memory 54 is addressed by the microprocessor 52 when energization temperature data are being written into the temperature memory 54, the history memory 66 is addressed by a controller 72 when energization history data are being written into the history memory 66. The history memory 66 contains a set of addresses for each printing element 14 which records whether the printing element will contribute to the printing of the image during the next scan line, during the current scan line, and during each of several previous scan lines.

Figure 5:
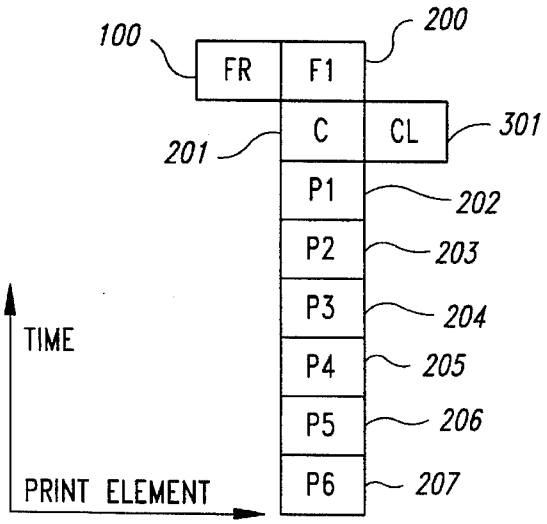
FIG. 5 is a schematic illustrating the format of data stored in a history memory used in the system of FIG. 4.

The manner in which the energization history is stored in the history memory 66 is illustrated in FIG. 5. The memory locations that are relevant to determining the energization level of a selected printing element 14 are shown in FIG. 5, it being understood that other memory locations that are relevant for determining the energization level of other printing elements 14 have been omitted for clarity. As illustrated in FIG. 5, the current energization level (i.e., whether the selected printing element 14 is to contribute to the printing of an image during the current scan line) is recorded at memory location "201." The energization state of the selected printing element for six previous scan lines are also recorded at memory locations "202"–"207", respectively. Finally, the energization state of the selected printing element for the next scan line is recorded at memory location "200". However, data indicative of the energization state of the printing elements adjacent the selected printing element are also used to determine the current energization state for the selected printing element. Specifically, the energization state for the printing element to the right of the selected printing element for the next scan line is recorded at memory location "100", while the energization state for the printing element to the left of the selected printing element for the current scan line is recorded at memory location "301." Thus, it will be seen that memory locations "200"–"207" correspond to the selected printing element 14, while memory locations "100"–"107" ("101"–"107" not shown) record data for the printing element to the right of the selected printing element. Memory locations "300"–"307" ("300" and "302"–"307" not shown) record data for the printing element to the left of the selected printing element. However, as mentioned above, memory locations "101"–"107" and "300", "302"–"307" are not shown because they are not used in the explained example to determine the energization state of the selected printing element 14. However, it will be understood that other techniques and data storage formats may be used without departing from the spirit of the invention. In fact, the embodiment illustrated in FIG. 1 can improve the precision of temperature control without utilizing any data indicative of the past or future energization states of the selected printing element 14 and without using any data for the energization states of the printing elements 14 adjacent to the selected printing element 14.

The microprocessor 52 initially writes data indicative of the energization state of each printing element 14 into a conventional first-in first-out image buffer 68. The data is then applied to the history memory 66 when it is addressed by the controller 72. Basically, the controller 72 writes a logic "1" into a location in the memory 66 for each printing element 14 to indicate that the printing element 14 corresponding to the memory location will contribute to the printing of an image during the next scan line. Conversely, the controller 72 will write a logic "0" into a location in the memory 66 to indicate that the corresponding printing element 14 corresponding to the memory location will not contribute to the printing of an image during the next scan line.

Returning, now, to FIG. 4, a printing element counter 70 outputs a data byte indicative of the currently selected printing element. The printing element counter 70 is clocked and reset by a controller 72 which may be a conventional programmable logic device programmed as explained below. The selected printing element byte from the printing element counter 70 is used to address the history memory 66 and the temperature memory 54 during read operations in which the heating signal for the selected printing element 14 is being applied to the selected printing element 14.

The system illustrated in FIG. 4 also includes a segment counter 80 which provides a data byte indicative of a segment of time during each scan line. As explained in greater detail below, the heating signal applied to each printing element is a multi-bit serial pulse train which, in the preferred embodiment, consists of 32 serial bits. As a result, the system illustrated in FIG. 4 not only controls the total amount of energy applied to each printing element 14 during a scan line, but also the manner (i.e. the time profile) in which the energy is being applied. For example, if a printing element 14 was not energized during the previous scan line but was to be energized during the current scan line, the early bits of the serial data would be logic "1" to quickly heat the printing element 14 during the current scan line. However, if the selected printing element 14 was energized during the previous scan line, then the early bits applied to the printing element might alternate logic "1" and logic "0" since it is not necessary to add as much energy to the selected printing element during the early portion of the scan line because it may already be hot from the previous scan line. In the embodiment illustrated in FIG. 4, the first bit (i.e., segment) for all of the printing elements 14 are applied to the printhead before the second bit is applied to any of the printing elements. The printing sequence is thus PE (printing element)-1, B(bit)1; PE-2, B1; PE-3, B1; . . . PE-256, B1; . . . PE-1, B2; PE-2, B2; . . . PE-256, B2; . . . PE-1, B 32; PE-2, B32; . . . PE-256, B32. Thus, the controller 72 clocks the printing element counter 70 256 times each time the controller 72 clocks the segment counter 80 once. However, it will be understood that other techniques may be used such as, for example, applying all 32 bits to the first printing element before stepping to the second printing element, etc.

The heating profile bits for each of the printing elements are actually stored in a table memory 90. The heating profiles for each combination of printing element temperature and printing element history are determined empirically or mathematically in a conventional manner. The data are then recorded in a conventional read-only memory forming part of the microprocessor 52. In fact, different sets of data are preferably stored in the read-only memory depending upon such variables as the characteristics of the print media and the print speed. In either case, prior to printing, the microprocessor 52 writes the heating profile bits into the table memory 90. There is an address location in table memory 90 for each unique combination of printing element temperature and history, and the data for the profile corresponding to that combination is stored in the corresponding table memory address location. Thus, during printing, the history memory 66 and the temperature memory 54 output an address on their data bus that corresponds to a composite of the temperature data from the temperature memory 54 and the history data from the history memory 66. Thus, for example, when the printing element counter 70 is incremented to printing element "24," the temperature memory 54 will output a data byte indicative of the approximate temperature of printing element "24" and the history memory 66 will likewise output a data byte (shown in FIG. 5) indicative of the printing history of printing element "24" as well as the current energization state of printing element "23" and the future energization state of printing element "25." Depending upon the combination of the temperature of printing element "24" and the energization history of printing element "24," the table memory 90 will output a 32-bit byte of data corresponding to the profile of the heating signal that will be applied to printing element "24" during the current scan line. However, not all 32 bits output from the table memory 90 will be applied to printing element "24" at the same time. Instead, a conventional multiplexer 92 will select the bit corresponding to the current segment count output from the segment counter 80. During the start of a scan line, the segment counter 80 will initially cause the multiplexer 92 to select the first bit for the printing element "24" heating profile. At the end of a scan line time, the segment counter 80 will cause the multiplexer 92 to select the thirty-second bit of the heating profile for printing element "24."

As explained above, the output of the printing element counter 70, which identifies the currently selected printing element 14, addresses the temperature memory 54 and the history memory 66 so that they will output data bytes corresponding to the selected printing element 14. The table memory 90 then outputs the profile byte for the selected printing element 14, and the segment counter 80 causes the multiplexer 92 to select one of those bits at a time which is supplied to the selected printing element 14. However, it will be apparent from FIG. 4 that, since the output of the printing element counter 70 is not applied to the printhead 12, the printhead has no direct information identifying the currently selected printing element. However, as is well known in the art, the printhead 12 contains a shift register into which the profile bits are clocked by the same clock that increments the printing element counter 70. Thus, if there is initially any discrepancy between the printing element 14 designated by the printing element counter 70, and the routing of a profile bit for that printing element 14 through the printhead 12, the discrepancy is eliminated after the first profile segment has been completed and all 256 bits of the first segment have been shifted through the printhead 12.

As is also well known in the art, the profile data are not normally applied to a printing element 14 during the entire time that the data is present on the data inputs to the printhead 12. Instead, the data are normally ANDed with a strobe signal to precisely control the time during which the heating byte is applied to each printing element 14. The system illustrated in FIG. 4 also generates a strobe signal using a conventional counter/timer 96 which is triggered by the microprocessor 52 in a conventional manner. The strobe signal generated by the counter/timer 96 is ANDed with the bit output from the multiplexer 92 by an AND gate which is part of conventional strobe circuitry normally found in conventional printheads 12.

Figure 6:
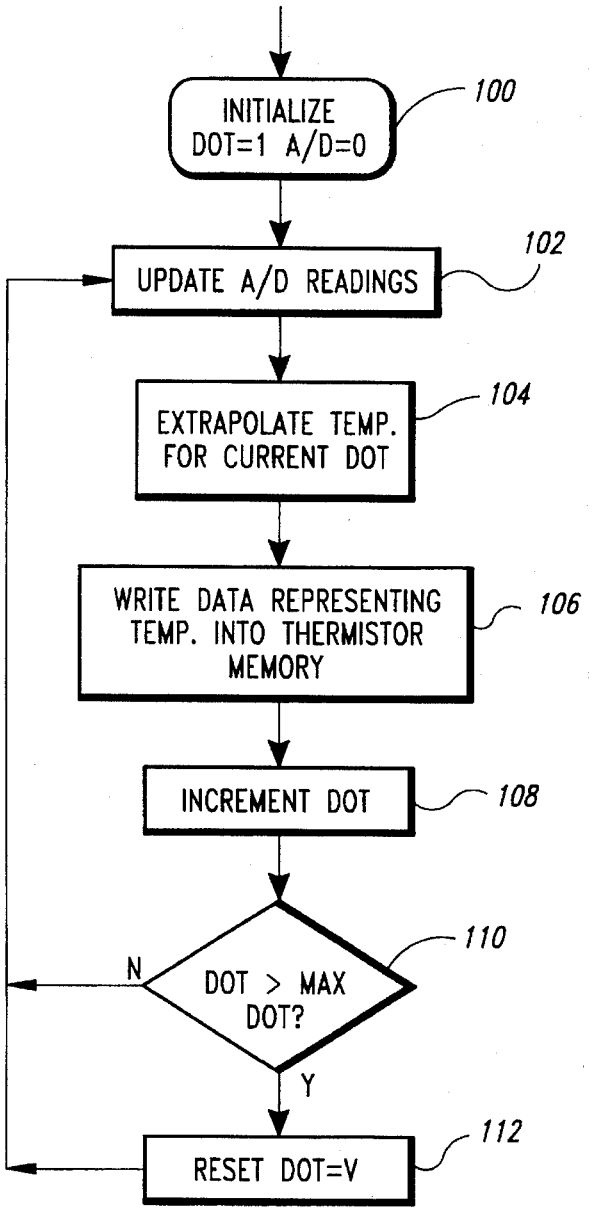
FIG. 6 is a flow chart showing the software controlling the operation of a processor used in the system of FIG. 4.

As mentioned above, the system shown in FIG. 4 is controlled by both a controller 72 and a microprocessor 52 which, inter alia, obtains temperature measurements from the temperature sensors 20 and writes corresponding temperature data into the temperature memory 54. A flow chart illustrating the software that causes the microprocessor 52 to perform these functions is shown in FIG. 6. However, it should be recognized that the program illustrated in FIG. 6 need not be run each time the controller 72 executes its functions during each scan line. As explained above, the use of printing element history to control the energy applied to printing elements provides short term temperature feedback, and thus must be performed relatively frequency. Temperature feedback from either multiple locations on the printhead or data indicative of the temperature of each printing element provides longer term feedback and thus need not be performed as frequently. Thus, the program illustrated in FIG. 6 may be executed much less frequently than the program for the controller 72 illustrated in FIG. 7, as explained below.

With reference to FIG. 6, the program is initialized at 100, at which time a software "dot counter" is reset to correspond to printing element "1." At step 102, the microprocessor 52 reads the temperature data for one of the temperature sensors 20 at the output of the analog-to-digital converter 50 and then determines the approximate temperature for the printing element currently designated by the software dot counter. The microprocessor 52 writes the temperature approximating the temperature of the printing element designated by the software dot counter into the temperature memory 54 at step 106. At step 108, the software dot counter is incremented by one, and, at 110, determines if the count of the software dot counter corresponds to the final printing element counter 70. If not, the program loops back to step 102 to perform the same steps described above for the second printing element and all subsequent printing elements until the final printing element is reached. The program then branches to step 112 where the software dot counter is reset to correspond to the first printing element.

Figure 7:
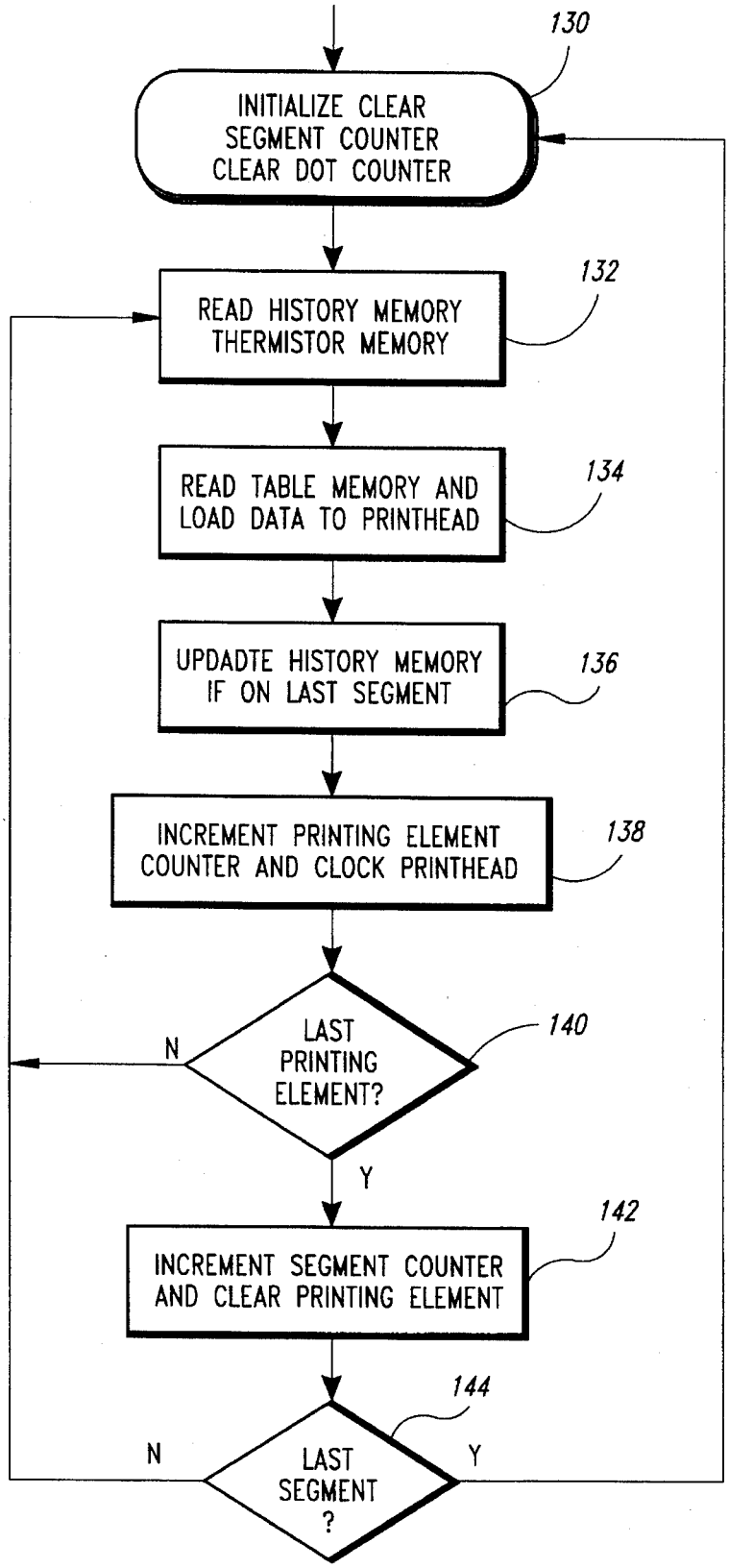
FIG. 7 is a state diagram showing the program controlling a programmable logic array used in the system of FIG. 4.

After the microprocessor 52 has read and processed the temperature data from all of the temperature sensors 20, the temperature memory 54 (FIG. 4) will contain data corresponding to the approximate temperature of each printing element 12. However, as mentioned above, since the temperature data provides relatively long term feedback, the temperature data in the temperature memory 54 can be updated periodically after several scan lines have been processed by the controller 72. Furthermore, it is not necessary that the data in the temperature memory 54 be derived from temperature measurements generated by the temperature sensors 20 during the same scan line. Thus, the data in temperature memory 54 for some printing elements 12 may be derived from their corresponding temperature sensors 20 at times that are different from when data in temperature memory 54 for other printing elements 12 are derived. After the first bit of the heating profile for printing element number "1" has been applied to the printhead 12, As also explained above earlier, the controller 72 is preferably a conventional programmable logic device which is programmed to provide the proper control of the printing element counter 70, segment counter 80, history memory 66, and table memory 90. The program is illustrated in block diagram form in FIG. 7. With reference to FIG. 7, the program initially resets the printing element counter 70 and resets the segment counter 80 at step 130. The controller 72 then applies appropriate control signals to the history memory 66 and the temperature memory 54 to cause them to output respective bytes at step 132. The combined data bytes output from the history memory 66 and the temperature memory 54 are applied to the address bus of the table memory 90. At step 134, the controller 72 applies appropriate control signals to the table memory 90 to read the profile byte at the address location corresponding to the combination of printing element history and temperature, and one of the bits on the data bus of the table memory 90 is selected by the multiplexer 92 to be coupled to the printhead 12. At step 136, the controller 72 applies appropriate control signals to the history memory 66 if the segment counter 80 has reached its terminal count so that data for the next scan line is written into the history memory 66 from the image buffer 68. The controller 72 then increments the printing element counter 70 and clocks the printhead 12 at step 138. The program then determines at 140 if the terminal count of the printing element counter 70 has been reached. If not, the program loops back to step 132 and repeats steps 132–138 for the next printing element. When a profile byte has been applied to the final printing element 12, the terminal count of the printing element counter 70 is reached, and the program then branches from 140 to 142 where the controller 72 increments the segment counter 80 and clears the printing element counter 70. The segment counter 80 then causes the multiplexer 92 to select the next bit of the profile byte for application to the printhead 12. After the segment counter 80 has been incremented, the program checks at 144 to determine if the terminal count of the segment counter has been reached. If not, the program returns to 132 to once again cause the table memory 90 to output profile bytes for each printing element temperature and history. If the final printing element 12 has been reached, the program will branch from 144 to 130 to clear both the printing element counter 70 and the segment counter 80. The program illustrated in FIG. 7 is once again repeated as explained above.

One advantage of the system illustrated in FIG. 4 is that it can be adapted to conventional control systems for printheads which, like the system shown in FIG. 4, utilize a history memory 66 for providing short-term thermal feedback, a printing element counter 70 for identifying the currently selected printing element, a segment counter 80 for sequentially selecting each bit of the profile byte for each printing element, and a table memory for recording and then outputting a profile byte for each printing element. However, conventional control systems for printheads have failed to recognize the advantage of intermediate term thermal feedback which can be obtained by selecting a profile based upon a combination of printing element temperature and printing element history.

Figure 8:
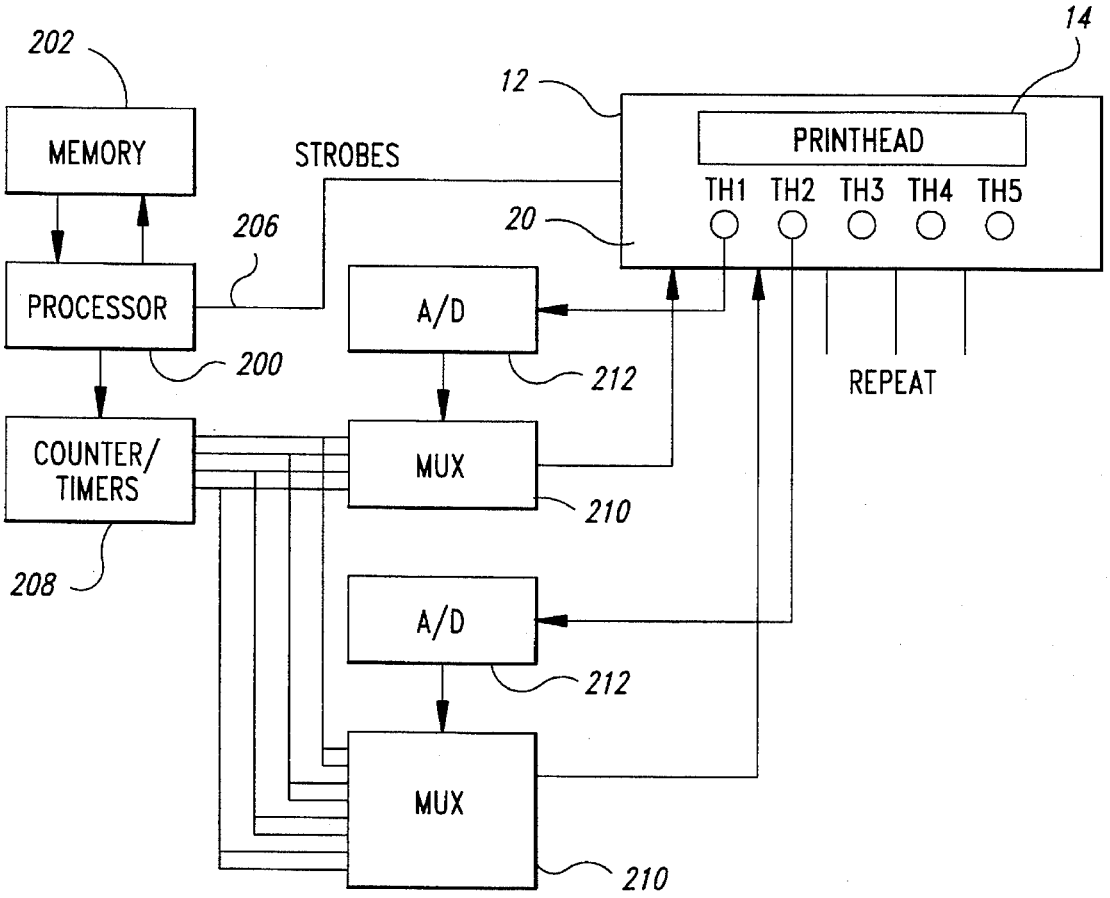
FIG. 8 is a block diagram showing an alternative system for implementing the preferred embodiment of the invention illustrated in FIG. 1.

An alternative design for implementing the preferred embodiment illustrated in FIG. 1 is shown in FIG. 8. The system shown in FIG. 8, like the system of FIG. 4, utilizes a processor 200 coupled to a memory 202, which may be a conventional random access memory. The processor 200 also receives image data via bus 204. The processor 200 then determines the energization state for each time segment of each printing element and records that information in memory 202. Prior to each scan line, the processor 200 loads the printhead 12 from the memory 202 via serial line 206 a byte of information specifying whether each printing element 14 is to be energized during the current scan line. The processor 200 then outputs a byte of information to a counter/timer 208 of conventional design corresponding to four different potential energy levels that should be applied to the printing element 14 at four different possible temperatures of the printing element 14. The counter timer 208 then outputs four different strobe signals of varying pulse width. During each scan line, one of these pulse widths is selected by each multiplexer 210, 210' depending upon the approximate temperature of the printing element 14. For this purpose, the selected printing element 14 is assigned the temperature of the closest temperature sensor 20. The analog output from the closest temperature sensor 20 is applied to an analog-to-digital converter 212 which generates a 2-bit control word that selects one of the four potential strobe signals generated by the counter/timer 208. In the embodiment illustrated in FIG. 8, the printing elements are paired with a respective temperature sensor 20. The potential strobe signals generated by the counter/timer 208 are selected by a multiplexer 210, 210' for each set of print elements associated with a temperature sensor 20. The temperature sensor 20 associated with the set of printing elements outputs an analog signal to a respective analog-to-digital converter 212, 212' which then selects the strobe signal for that set of printing elements.

Figure 9:
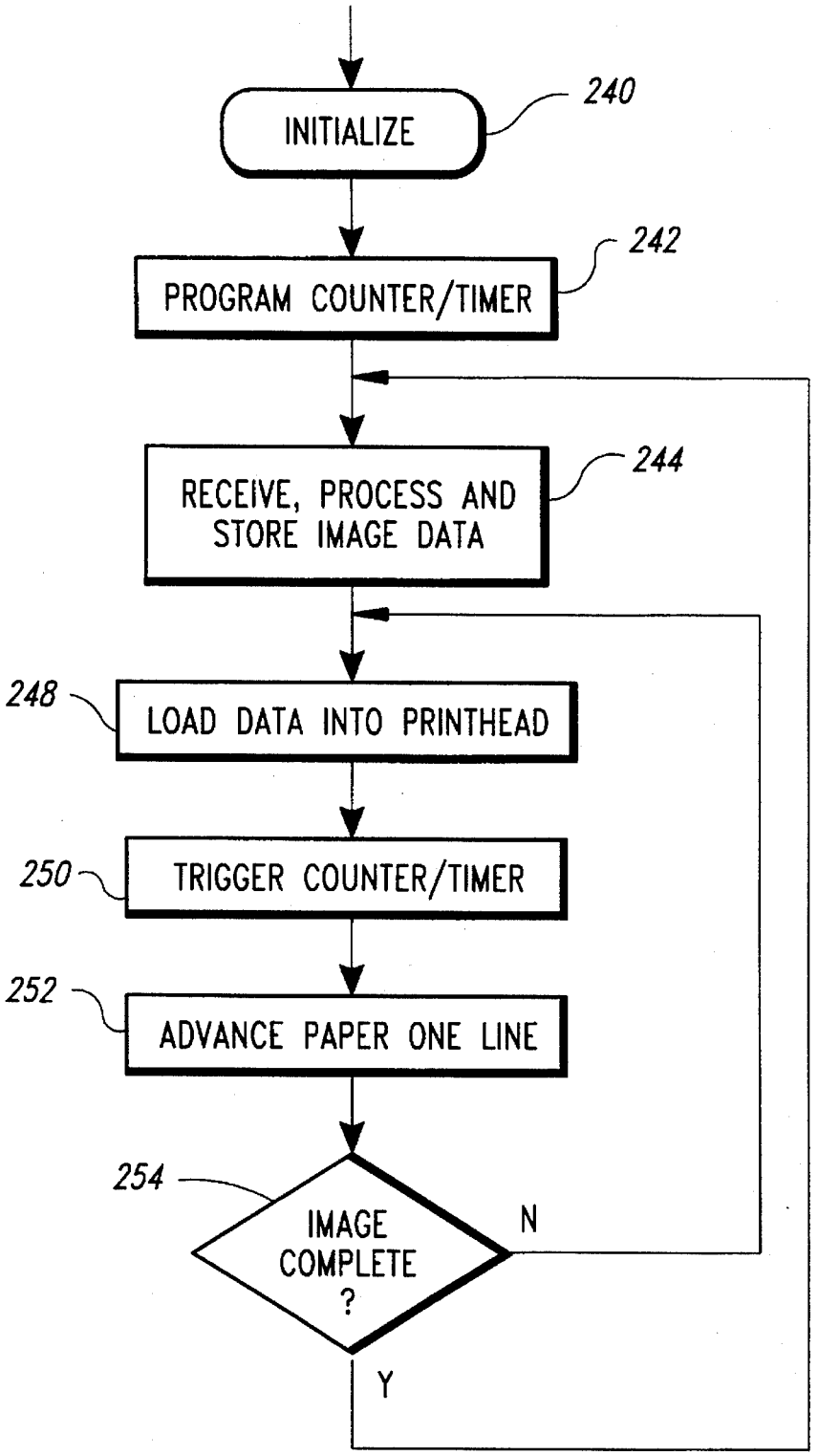
FIG. 9 is a flow chart showing the software controlling the operation of a processor used in the system of FIG. 8.

The processor 200, like the processor 52 of FIG. 4, is controlled by a set of software instructions, a flow chart for which is illustrated in FIG. 9. The program is initialized at step 240 in a conventional manner such as, for example, by resetting the internal counters that designate the temperature sensor and set of printing elements being strobed. At 242, the counter/timer 208 is programmed by the processor 200 to generate a set of 4 potential strobe signals corresponding to 4 different possible printing element temperatures. The processor 200 receives the image data, defines whether each printing element 14 will be energized during each scan line, and writes that information into the memory 202 at step 244. At the start of each scan line, the program loads data for the current scan line from memory 202 into the printhead 12 at 248, and then triggers the counter/timers 208 at 250 to generate the 4 potential strobe signals. One of these potential strobe signals is selected by the multiplexer 210 as determined by the analog-to-digital converter 212, as explained above. The strobe signal selected by the multiplexer 210 is then applied to the printhead 12 to cause a line of the image to be printed in accordance with the data loaded into the printhead 12 from the memory 202 at step 244, above. After the current scan line, the program causes the print media to advance one line at 252, and the program then checks at 254 to determine if the complete image has been printed. If not, the program returns to loop through steps 248 and 250 to print the next line of data, as explained above. When the entire image has been printed, the program branches from 254 back to step 244 where the program receives image data corresponding to a new image, processes that data to define whether each printing element 14 will be energized during each scan line, and writes that information into the memory 202 at step 244. The program is then executed once again as explained above.

Figure 10:
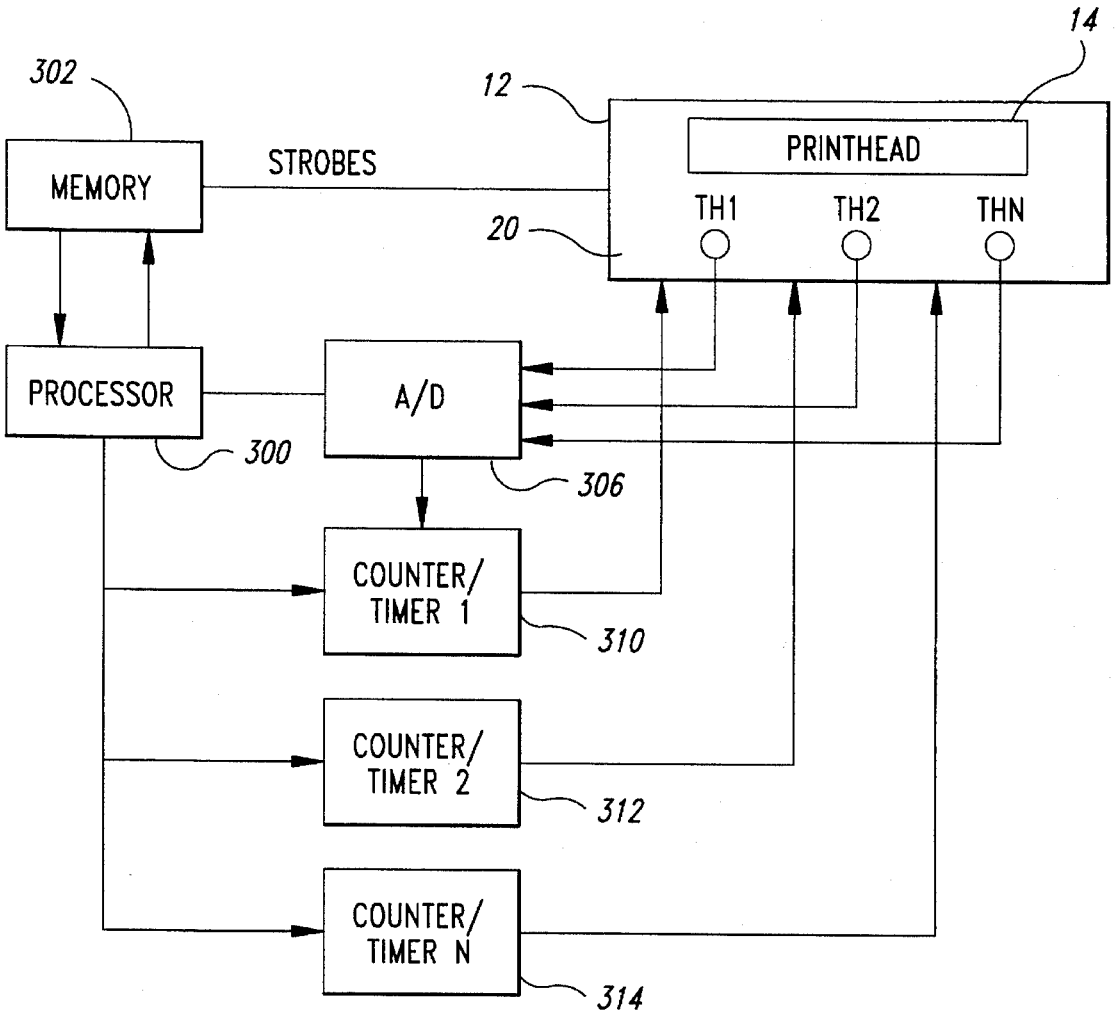
FIG. 10 is a block diagram showing still another alternative system for implementing the preferred embodiment of the invention illustrated in FIG. 1.

Still another embodiment of the preferred embodiment of FIG. 1 is illustrated in FIG. 10. The system of FIG. 10, like the systems of FIGS. 8 and 4, utilize a processor 300 connected to a conventional memory 302. The processor 300 receives image data via bus 304 and, after processing that data, stores bits indicating whether each printing element will be energized for each scan line and records that information in memory 302. The processor 300 also periodically samples the output of an analog-to-digital converter 306 to determine the temperature indicated, by each temperature sensor 20, and determines the approximate temperature of each printing element 14 by one of the techniques described above. The processor then stores data corresponding to the approximate temperature of each temperature sensor 20 in the memory 302, and periodically uses that data to determine an appropriate strobe signal for each printing element based upon the approximate temperature of the printing element. The processor 300 then outputs data bytes corresponding to the energization level of the strobe to conventional counter/timers 310–314 which output respective strobe signals to the printing element 14 adjacent the respective temperature sensors 20.

At the start of each scan line, the program loads data for the current scan line from memory 202 into the printhead 12, and then triggers the counter/timers 310, 312, 314 to cause the printhead 12 to print a line of the image in accordance with the data loaded into the printhead 12 from the memory 202.

Figure 11:
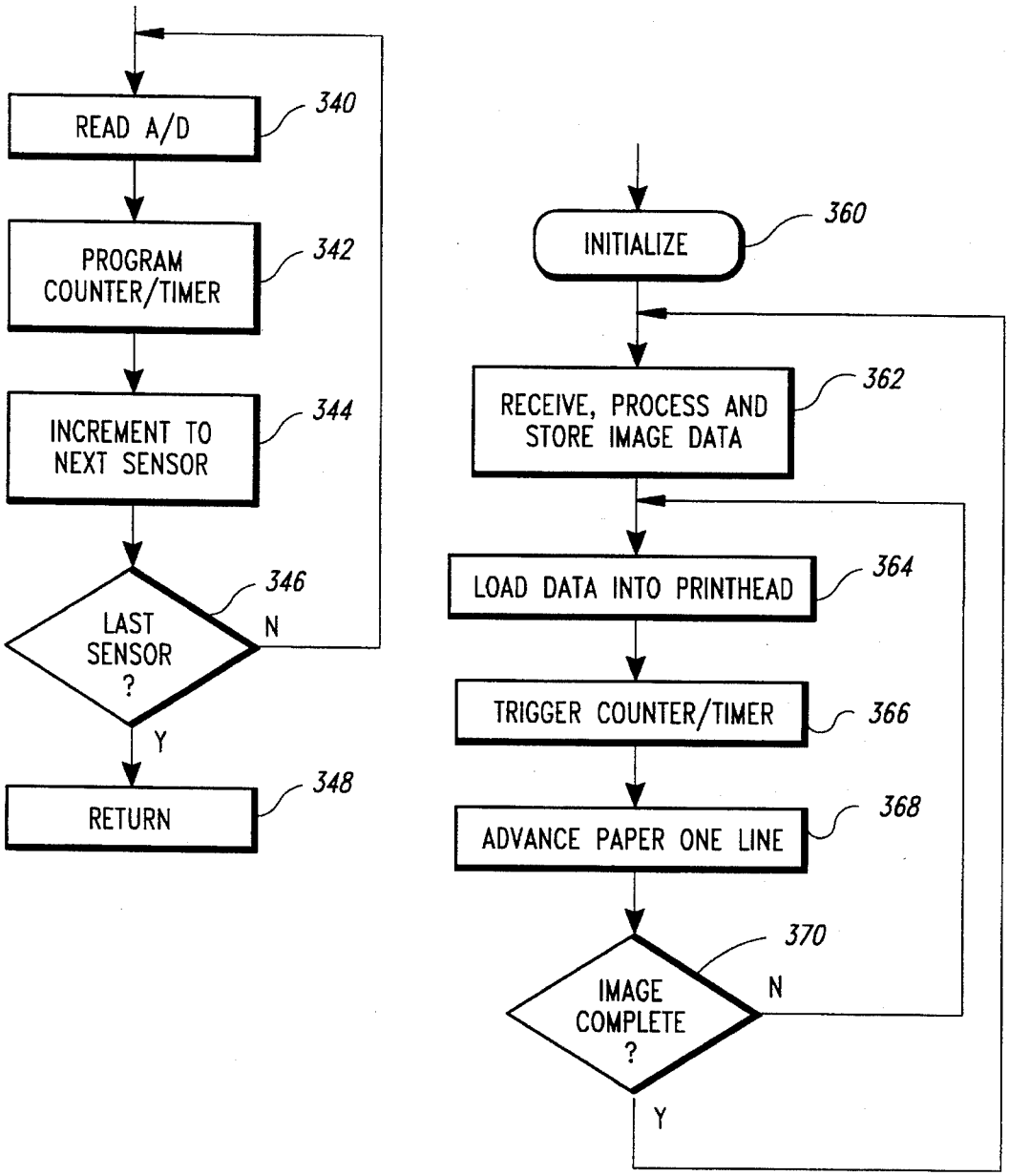
FIG. 11 is a flow chart showing the software controlling the operation of a processor used in the system of FIG. 10.

With reference to FIG. 11, the processor 300 is controlled by a set of software instructions including a main program and an interrupt routine. The interrupt routine performs the function of processing the outputs from the temperature sensors 20 and programming the counter timers 310, 312, 314. The main program performs the actual printing by loading data into the printhead 12 and triggering the counter timers 310, 312, 314. With reference to FIG. 11, the interrupt routine is entered at step 340 where the processor reads the output of the A/D converter 306 and stores corresponding data in memory 302. The processor 300 then programs the counter/timers 310–314 at step 342 and increments an internal counter to the next temperature sensor 20 at step 344. The routine then checks at 346 to determine if the final temperature sensor has been reached. If not, the routine loops back to 340 to once again sample the output of the analog-to-digital converter 306 corresponding to the output of the next temperature sensor 20. When the routine determines at 346 that the final temperature sensor has been reached, the routine returns to the main program via 348. As is well known in the art, the interrupt routine is executed periodically by a software timer internal to the processor 300.

The main routine is entered at 360 where the processor 300 is initialized in a conventional manner. At 362, the processor 300 receives the image data, defines whether each printing element 14 will be energized during each scan line, and writes that information into the memory 302. At the start of each scan line, the program loads data for the current scan line from memory 302 into the printhead 12 at 364, and then triggers the counter/timers 310–314 at 366 to generate the 4 strobe signals that are applied to the printhead 12. The strobe signals cause a line of the image to be printed in accordance with the data loaded into the printhead 12 from the memory 302 at step 364, above. After the current scan line, the program causes the print media to advance one line at 368, and the program then checks at 370 to determine if the complete image has been printed. If not, the program returns to loop through steps 364–368 to print the next line of data, as explained above. When the entire image has been printed, the program branches from 370 back to step 362 where the program receives image data corresponding to a new image, processes that data to define whether each printing element 14 will be energized during each scan line, and writes that information into the memory 302. The program is then executed once again as explained above.

It is thus seen that the inventive method and apparatus for controlling a thermal printhead is able to provide more precise temperature control of thermal printing elements, and the preferred embodiment of the invention can be implemented through a variety of circuit designs.

We claim:

1. A system for thermally printing an image on a media, comprising:

a thermal printhead having a plurality of thermal printing elements arranged in a predetermined pattern, said printhead further including a plurality of temperature sensors each of which generates a respective temperature signal that is indicative of a temperature of a portion of the printhead containing said temperature sensors; and a processor connected to said temperature sensors, said processor determining an approximate temperature of each of said printing elements based upon the temperature signal from at least one of said temperature sensors spatially associated with each of said printing elements; said processor further applying an output signal to each of said printing elements selected during a scan line, said output signal corresponding to the approximate temperature of the each of said printing elements selected and whether the each of said printing elements selected contributes to the printing of said image during said scan line.

2. The system of claim 1 further including: a memory accessed by said processor, said memory containing data corresponding to whether the each of said printing elements contributes to the printing of said image during said scan line.

3. The system of claim 2 wherein:

said memory contains a plurality of data bytes each of which corresponds to the quantity of energy that is to be added to a respective printing element as a function of the temperature of the each of said printing elements and whether the each of said printing elements contributes to the printing of said image;

said processor is connected to said temperature sensors and to said memory, said processor addressing said memory to select a data byte for the each of said printing elements selected as a function of the approximate temperature of the each of said printing elements selected and whether the each of said printing elements selected is to contribute to the printing of said image during said each scan line; and said controller applies a power signal to the each of said printing elements selected as a function of said selected data byte.

4. The system of claim 3 wherein the data bytes contained in said memory are a function of whether the each of said printing elements selected is to contribute to the printing of said image during both a current scan line and a scan line temporally spaced from said current scan line.

5. The system of claim 4 wherein the data bytes contained in said memory are a function of whether a printing element adjacent the each of said printing elements selected has or will contribute to the printing of said image during either said current scan line or a scan line temporally spaced from said current scan line.

6. The system of claim 5 wherein the data bytes contained in said memory are a function of:

whether the each of said printing elements selected is to contribute to the printing of said image during a current scan line;

whether the each of said printing elements selected has contributed to the printing of said image during a plurality of previous scan lines;

whether the each of said printing elements selected will contribute to the printing of said image during a subsequent scan line; and whether each printing element adjacent the each of said printing elements selected has or will contribute to the printing of said image during any scan line.

7. The system of claim 6 wherein the data bytes contained in said memory are a function of: whether a first printing element adjacent the each of said printing elements selected has contributed to the printing of said image during a scan line previous to said current scan line and whether a second printing element adjacent the each of said printing elements selected opposite said first printing element will be contributed to the printing of said image during a scan line subsequent to said current scan line.

8. The system of claim 3 wherein the data bytes contained in said memory are further a function of whether a printing element adjacent the each of said printing elements selected has or will contribute to the printing of said image during either said current scan line or a scan line temporally spaced from said current scan line.

9. The system of claim 8 wherein the data bytes contained in said memory are a function of:

whether the each of said printing elements selected is to contribute to the printing of said image during a current scan line;

whether the each of said printing elements selected has contributed to the printing of said image during a plurality of previous scan lines;

whether the each of said printing elements selected will contribute to the printing of said image during a subsequent scan line; and whether each printing element adjacent the each of said printing elements selected has or will contribute to the printing of said image during any scan line.

10. The system of claim 9 wherein the data bytes contained in said memory are a function of: whether a first printing element adjacent the each of said printing elements selected has contributed to the printing of said image during a scan line previous to said current scan line and whether a second printing element adjacent the each of said printing elements selected opposite said first printing element will be contributed to the printing of said image during a scan line subsequent to said current scan line.

11. The system of claim 3 wherein said memory comprises:

a temperature memory containing data indicative of the approximate temperature of each of said printing elements; and a history memory containing data indicative of the printing elements that have and will contribute to the printing of said image during a plurality of scan lines.

12. The system of claim 11 wherein said controller comprises: a table memory containing data indicative of a plurality of heating profiles each of which corresponds to the energy that should be added to each of said printing elements as a function of time based on the approximate temperature of the each of said printing elements and whether the each of said printing elements has contributed and/or will contribute to the printing of said image during a plurality of scan lines, said table memory being addressed by an address formed from respective data bytes output from said temperature memory and said history memory thereby outputting a selected data byte which controls the heating of the each of said printing elements selected during a current scan line.

13. The system of claim 12 wherein said controller serially applies the bits of said selected data byte to said printhead so that the each of said printing elements selected is sequentially energized according to the bits of data sequentially applied to said printhead.

14. The system of claim 12 wherein said processor loads said table memory with a set of said data bytes, each of said data byte sets corresponding to a predetermined media on which said image is to be printed by said printhead.

15. The system of claim 12 wherein said processor load said table memory with a set of said data bytes, each of said data byte sets corresponding to a predetermined print speed with which said image is to be printed by said printhead.

16. The system of claim 1 wherein said output signal is a function of the approximate temperature of said printing elements, wherein the each of said printing elements selected is positioned between a pair of said temperature sensors, and wherein said processor calculates the approximate temperature of a selected printing element to generate said output signal for the selected printing element, said processor calculating the approximate temperature of the each of said printing elements selected as the average of the temperatures sensed by said pair of temperature sensors.

17. The system of claim 1 wherein said output signal is a function of the temperature of said printing elements, wherein the each of said printing elements selected is positioned between a pair of said temperature sensors, and wherein said processor calculates the approximate temperature of a selected printing element to generate said output signal for the selected printing element, said processor calculating the approximate temperature of the each of said printing elements selected by interpolating between the temperatures sensed by said pair of temperature sensors as a function of the position of the each of said printing elements selected relative to said pair of temperature sensors.

18. The system of claim 1 wherein said output signal is a function of the temperature of said printing elements, wherein there is one of said temperature sensors positioned adjacent each of said printing elements, and wherein said processor calculates the temperature of a selected printing element to generate said output signal for the selected printing element, said processor determining the approximate temperature of the each of said printing elements selected from the temperature signal generated by the temperature sensor corresponding to the each of said printing elements selected.

19. The system of claim 1 wherein said output signal is a function of the approximate temperature of said printing elements, wherein one of said temperature sensors is positioned at a center of each of a plurality of adjacent groups of said printing elements, and wherein said processor calculates the approximate temperature of a selected printing element to generate said output signal for the selected printing element, said processor determining the approximate temperature of the each of said printing elements selected from the temperature signal generated by the temperature sensor corresponding to the group in which the each of said printing elements selected is contained.

20. The system of claim 1 wherein said processor generates a strobe signal for each printing element based on the approximate temperature of said printing element.

21. The system of claim 20 wherein said processor includes a strobe generator comprising a waveform generator generating as said strobe signal a pulse train having characteristics determined by a strobe program signal, said strobe program signal being applied to said waveform generator by said processor.

22. The system of claim 20 wherein said processor includes a strobe generator comprising a waveform generator producing a plurality of different pulse trains at respective outputs from said waveform generator, and a multiplexer connected to said waveform generator and to said processor, said multiplexer selecting as said strobe signal one of said pulse trains as a function of one of said temperature signals.

23. A system for thermally printing an image on a media, comprising:

a thermal printhead having a plurality of thermal printing elements arranged in a predetermined pattern, said printhead further including a plurality of temperature sensors each of which generates a respective temperature signal that is indicative of a temperature of a portion of the printhead containing at least one of said plurality of temperature sensors;

a first processor connected to said temperature sensors, said first processor determining the approximate temperature of each of said printing elements as a function of the temperature signals generated by said temperature sensors and their spatial relationship to said printing elements;

a temperature memory connected to said first processor, said temperature memory receiving and storing data corresponding to the approximate temperature of each of said printing elements;

a history memory containing data corresponding to whether each of said printing elements is to contribute to the printing of said image during a scan line;

a printing element counter sequentially selecting each of a plurality of printing elements by outputting a respective data byte corresponding thereto, said printing element counter addressing said temperature memory and said history memory so that said temperature memory and said history memory sequentially output respective temperature bytes and history bytes corresponding to the approximate temperature of said selected printing element and whether said selected printing element is to contribute to the printing of said image during said scan line; and a table memory containing a plurality of data bytes each of which corresponding to the energy that is to be added to a printing element as a function of the approximate temperature of said printing element and the manner in which said printing element contributes to the printing of said image, said table memory being sequentially addressed by respective addresses each of which is formed from a temperature byte and a history byte corresponding to one of said selected printing elements, said table memory applying to said printhead the data byte stored therein at a location designated by said address so that said data byte controls the heating of said selected printing element as a function of time during said scan line.

24. The system of claim 23 wherein the data bytes contained in said history memory are a function of whether each corresponding printing element is to contribute to the printing of said image during both said current scan line and a scan line temporally spaced from said current scan line.

25. The system of claim 24 wherein the data bytes contained in said history memory are further a function of whether a printing element adjacent said selected printing element has or will contribute to the printing of said image during either said current scan line or said scan line temporally spaced from said current scan line.

26. The system of claim 25 wherein the data bytes contained in said history memory are a function of:

whether said selected printing element is to contribute to the printing of said image during said current scan line;

whether said selected printing element has contributed to the printing of said image during a plurality of previous scan lines;

whether said selected printing element will contribute to the printing of said image during a subsequent scan line; and whether each printing element adjacent said selected printing element has or will contribute to the printing of said image during any scan line.

27. The system of claim 26 wherein the data bytes contained in said history memory are a function of: whether a first printing element adjacent said selected printing element has contributed to the printing of said image during a scan line previous to said current scan line and whether a second printing element adjacent said selected printing element opposite said first printing element will contributed to the printing of said image during a scan line subsequent to said current scan line.

28. The system of claim 23 wherein the data bytes contained in said memory are further a function of whether a printing element adjacent said selected printing element has or will contribute to the printing of said image during either said current scan line or a scan line temporally spaced from said current scan line.

29. The system of claim 28 wherein the data bytes contained in said history memory are a function of:

whether said selected printing element is to contribute to the printing of said image during said current scan line;

whether said selected printing element has contributed to the printing of said image during a plurality of previous scan lines;

whether said selected printing element will contribute to the printing of said image during a subsequent scan lines; and whether each printing element adjacent said selected printing element has or will contribute to the printing of said image during any scan line.

30. The system of claim 29 wherein the data bytes contained in said history memory are a function of: whether a first printing element adjacent said selected printing element has contributed to the printing of said image during a scan line previous to said current scan line and whether a second printing element adjacent said selected printing element opposite said first printing element will contributed to the printing of said image during a scan line subsequent to said current scan line.

31. The system of claim 23 wherein the bits of each data byte output from said table memory are sequentially applied to said print head.

32. The system of claim 23 wherein said processor further loads said table memory with one of plurality of sets of said data bytes, each of said data byte sets corresponding to a predetermined media on which said image is to be printed by said printhead.

33. The system of claim 23 wherein said processor further loads said table memory with one of plurality of sets of said data bytes, each of said data byte sets corresponding to a predetermined print speed with which said image is to be printed by said printhead.

34. A method of controlling the heating of a thermal printhead having a plurality of thermal printing elements arranged in a predetermined pattern, said method comprising the steps of:

measuring a temperature of said printhead at a plurality of spaced apart temperature measuring locations on said printhead;

determining an approximate temperature of each of said printing elements based on the temperature of at least one temperature measuring location and the proximity of said each of said printing elements to said at least one temperature measuring location; and sequentially applying a respective heating signal to each of said plurality of said printing elements, said heating signal being a function of the approximate temperature of a respective one of said each of said printing elements and whether the respective one of said each of said printing elements is to contribute to the printing of an image during a scan line.

35. The method of claim 34 wherein each of said heating signals is further a function of whether said each of said printing elements is to contribute to the printing of said image during both a current scan line and a scan line temporally spaced from said current scan line.

36. The method of claim 35 wherein each of said heating signals is further a function of whether a printing element adjacent said each of said printing elements has or will contribute to the printing of said image during either said current scan line or said scan line temporally spaced from said current scan line.

37. The method of claim 36 wherein each of said heating signals is further a function of:

whether said each of said printing elements is to contribute to the printing of said image during a current scan line;

whether said each of said printing elements has contributed to the printing of said image during a plurality of previous scan lines;

whether said each of said printing elements will contribute to the printing of said image during a subsequent scan line; and whether the printing element adjacent to said each of said printing elements has or will contribute to the printing of said image during any scan line.

38. The method of claim 34 wherein each of said heating signals is a pulse train corresponding to a series of data bits from a data byte that is indicative of the energy to be added to said each of said printing elements based on the approximate temperature of said each of said printing elements and whether said printing element is to contribute to the printing of said image during a scan line.

39. The method of claim 34 wherein each of said heating signals is further a function of: a nature of the media on which said image is to be printed by said printhead.

40. The method of claim 34 wherein each of said heating signals is further a function of: a speed with which said image is to be printed on a media by said printhead.

41. The method of claim 34 wherein selected printing elements are positioned between respective pairs of said temperature measuring locations, and wherein the approximate temperature of said each of said printing elements is determined as the average of the temperatures at said temperature measuring locations.

42. The method of claim 34 wherein selected printing elements are positioned between respective pairs of said temperature measuring locations, and wherein the approximate temperature of said each of said printing elements is determined by interpolating between the temperatures at said temperature measuring locations as a function of the position of said printing element relative to said temperature measuring locations.

43. The method of claim 34 wherein there is one of said temperature measuring locations positioned adjacent said each of said printing elements, and wherein the approximate temperature of said each of said printing elements is determined from the temperature of the temperature measuring location corresponding to the respective one of said each of said printing elements.

44. The method of claim 34 wherein there is one of said temperature measuring locations positioned at a center of each of a plurality of adjacent groups of said each of said printing elements, and wherein the approximate temperature of said each of said printing elements is determined from a temperature of a respective one of the temperature measuring locations corresponding to a group in which said each of said printing elements is contained.

45. The method of claim 34 wherein said heating signal is a multi-bit strobe signal that selectively gates a power signal to said each of said printing elements, the bits of said strobe signal corresponding to the energy that is to be added to said printing element based on the approximate temperature of said each of said printing elements.

* * * * *